US005568834A

United States Patent [19]

Korenberg

[11] Patent Number: 5,568,834

[45] Date of Patent: Oct. 29, 1996

[54] HIGH TEMPERATURE HEAT EXCHANGER

[75] Inventor: Jacob Korenberg, York, Pa.

[73] Assignee: Donlee Technologies, Inc., York, Pa.

[21] Appl. No.: 382,191

[22] Filed: Feb. 1, 1995

[51] Int. Cl.[6] ..... F28D 13/00

[52] U.S. Cl. ..... 165/104.16; 422/146; 422/145; 422/141

[58] Field of Search ..... 165/104.16, 104.15; 422/200, 146, 145, 144, 141; 122/4 D

[56] References Cited

U.S. PATENT DOCUMENTS

| | | | |
|---|---|---|---|
| 2,697,653 | 12/1954 | Nicholson | 165/104.16 X |
| 3,921,307 | 11/1975 | Marek et al. | 165/104.16 X |
| 4,080,181 | 3/1978 | Feistel et al. | 422/146 X |
| 4,338,283 | 7/1982 | Sakamoto et al. | 165/104.16 X |
| 4,545,959 | 10/1985 | Schilling et al. | 422/146 X |
| 4,971,141 | 11/1990 | Kasahara et al. | 165/104.16 X |
| 5,040,492 | 8/1991 | Dietz | 122/4 D |
| 5,108,712 | 4/1992 | Alliston et al. | 165/104.16 X |
| 5,218,932 | 6/1993 | Abdulally | 165/104.16 X |
| 5,341,766 | 8/1994 | Hyppanen | 165/104.16 X |

FOREIGN PATENT DOCUMENTS

| | | | |
|---|---|---|---|
| 3345235 | 6/1985 | Germany | 165/104.16 |
| 0219119 | 5/1968 | U.S.S.R. | 165/104.16 |
| 0775591 | 10/1980 | U.S.S.R. | 165/104.16 |
| 1301103 | 12/1972 | United Kingdom | 165/104.16 |

*Primary Examiner*—John Rivell
*Assistant Examiner*—Christopher Atkinson
*Attorney, Agent, or Firm*—Finnegan, Henderson, Farabow, Garrett & Dunner, L.L.P.

[57] ABSTRACT

The heat exchanger includes a hot fluid passage for guiding hot fluid through the heat exchanger, a compartment for containing a fluidized bed, a series of nozzles for forcing particulates from the fluidized bed into the hot fluid, a heat transfer device in contact with the fluidized bed, means for separating particulates from the fluid that has passed through the hot fluid passage, and a return passage for returning separated particulates to the fluidized bed in the compartment. The fluid is guided over the upper surface of the fluidized bed. Air is blown through the series of nozzles to force particulates from the fluidized bed into the fluid in the hot fluid passage where they pick up heat from the fluid, and the particulates then fall back into the bed and transfer heat to the fluidized bed. The heat transfer device removes heat from the fluidized bed and transfers it to a working fluid without being in contact with the hot fluid passage.

26 Claims, 6 Drawing Sheets

HIGH TEMPERATURE HEAT EXCHANGER

BACKGROUND OF THE INVENTION

1. Field of the Invention

The present invention relates to heat exchangers. More particularly, the present invention relates to high temperature heat exchangers.

2. Description of the Related Art

Presently known heat exchanger systems cannot operate efficiently with dirty and corrosive flue gases. One such known system is referred to as the dual fluidized bed waste heat recovery system. In this dual bed system, a "hot" fluidized bed is mounted above a "cold" fluidized bed. The air distributor of the hot fluidized bed is subject to a harsh environment in which the high temperature combustion gases cause severe corrosion, fouling, and warping. This system has many disadvantages relating to reliability concerns and high capital costs. Also, this dual bed system has been shown to have limited efficiency with respect to heat transfer before the flue gases are exhausted into the atmosphere.

In an effort to improve upon the dual bed system, a raining bed waste heat recovery system was devised in which the hot fluidized bed was replaced with a "raining bed" where hot combustion gases flow upwards against solid particulates discharged from a cyclone separator. These solid particulates eventually settle on the bottom of the raining fluidized bed. Although this system eliminated some of the problems associated with the dual bed system, there remain a number of problems relating to limitations on efficiency, high capital costs, and poor reliability due to a complicated system of solids recirculation.

Presently known heat exchangers are not adequate for removing heat from high temperature fluids containing contaminants. The contaminants often foul or corrode the heat exchanger, thereby decreasing its reliability and efficiency. A heat exchanger that can satisfactorily remove heat from a fluid containing contaminants is particularly needed, for example, to increase the efficiency of industrial processes. Often an industrial process will waste a significant amount of the thermal energy injected into and generated by the process when it expels high temperature waste gases to the atmosphere. A process expelling waste gases at temperatures of 2000° F. may be losing more than 55 percent of the thermal energy injected into and generated by the process. The cumulative effect of such efficiency losses is significant. A tremendous savings could be realized if a heat exchanger existed that would more effectively and reliably recover heat from the waste gases.

An alloying process used in the secondary aluminum industry exemplifies the problem that contaminants in the waste gases of an industrial process present to known heat exchangers. In this process, magnesium is the primary contaminant in scrap aluminum. Magnesium is removed in a smelting furnace by bubbling chlorine through melted aluminum to form magnesium chloride, which is skimmed from the surface of the aluminum. However, some of the chlorine escapes into the waste gases and severely corrodes known metallic heat exchangers. Thus, no satisfactory heat exchanger is presently available to recover heat from the over 2000° F. waste gases produced by aluminum smelting furnaces. Similar problems exist in other industries, such as titanium pigment production, formaldehyde production, phosphoric acid production, mineral wood production, and glass melting.

The high temperature heat exchanger can also find an application in the Integrated Gasification Combined Cycle (IGCC) systems and be used to reduce temperature before high temperature coal and flue gas filters. This would reduce the overall power plant capital cost and increase its reliability.

A heat exchanger is needed that can adequately recover heat from waste gases in industrial processes. Further, a heat exchanger is needed that can recover heat from a wide range of contaminated gases without being fouled or corroded. Also, there is a need for a low-cost heat exchanger that can operate under the described conditions.

SUMMARY OF THE INVENTION

An object of the invention is to provide a reliable, efficient, and low cost heat exchanger.

A second object of the invention is to provide a heat exchanger that can recover thermal energy from gaseous fluids containing contaminants.

A third object of the invention is to provide a heat exchanger that can be used to recover thermal energy from high temperature waste gases generated by a variety of industrial processes.

A fourth object of the present invention is to provide a heat exchanger that can potentially capture corrosive pollutants.

Additional objects and advantages of the invention will be set forth in part in the description that follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a heat exchanger including a hot fluid passage for guiding hot fluid through the heat exchanger, a compartment for containing a fluidized bed, the compartment exposing an upper surface of the fluidized bed to the fluid in the hot fluid passage, a heat transfer device in contact with the fluidized bed, means for separating particulates from the fluid that has passed through the hot fluid passage, and a return passage for returning separated particulates to the fluidized bed in the compartment.

The invention also includes a method for exchanging heat, comprising the steps of guiding fluid over a substantially horizontal, upper surface of a fluidized bed in a heat exchanger, forcing solid particulates from the fluidized bed into the fluid, removing heat from the fluidized bed, separating particulates from the fluid, and returning separated particulates to the fluidized bed.

The apparatus and method of the present invention reduce fouling and corrosion of the components of the heat exchanger by substantially eliminating direct contact between the hot fluid and components of the heat exchanger that are adversely affected by contaminants in the hot fluid. Thus, the present invention provides an apparatus and method that can reliably and efficiently recover heat from a wide variety of fluids having contaminants. The present invention thus can be used with, for example, industrial processes having corrosive waste gases.

It is to be understood that both the foregoing general description and the following detailed description are exemplary and explanatory only and are not restrictive of the invention, as claimed..

The accompanying drawings, which are incorporated in and constitute a part of this specification, illustrate an embodiment of the invention and together with the description, serve to explain the principles of the invention.

BRIEF DESCRIPTION OF THE DRAWINGS

FIG. 4(*a*) is an enlarged view of the nozzles depicted in FIG. 4.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

In accordance with the present invention, the heat exchanger includes a hot fluid passage, a compartment for containing a fluidized bed, a heat transfer device, means for separating particulates from the hot fluid, and a return passage. In the preferred embodiment, the shape of the heat exchanger is that of a hollow parallelepiped. The top portion of the parallelepiped constitutes a hot fluid passage, and the bottom portion constitutes a compartment for holding a fluidized bed. The entire parallelepiped is formed of refractory lined walls or other temperature resistant materials.

Figure 1:
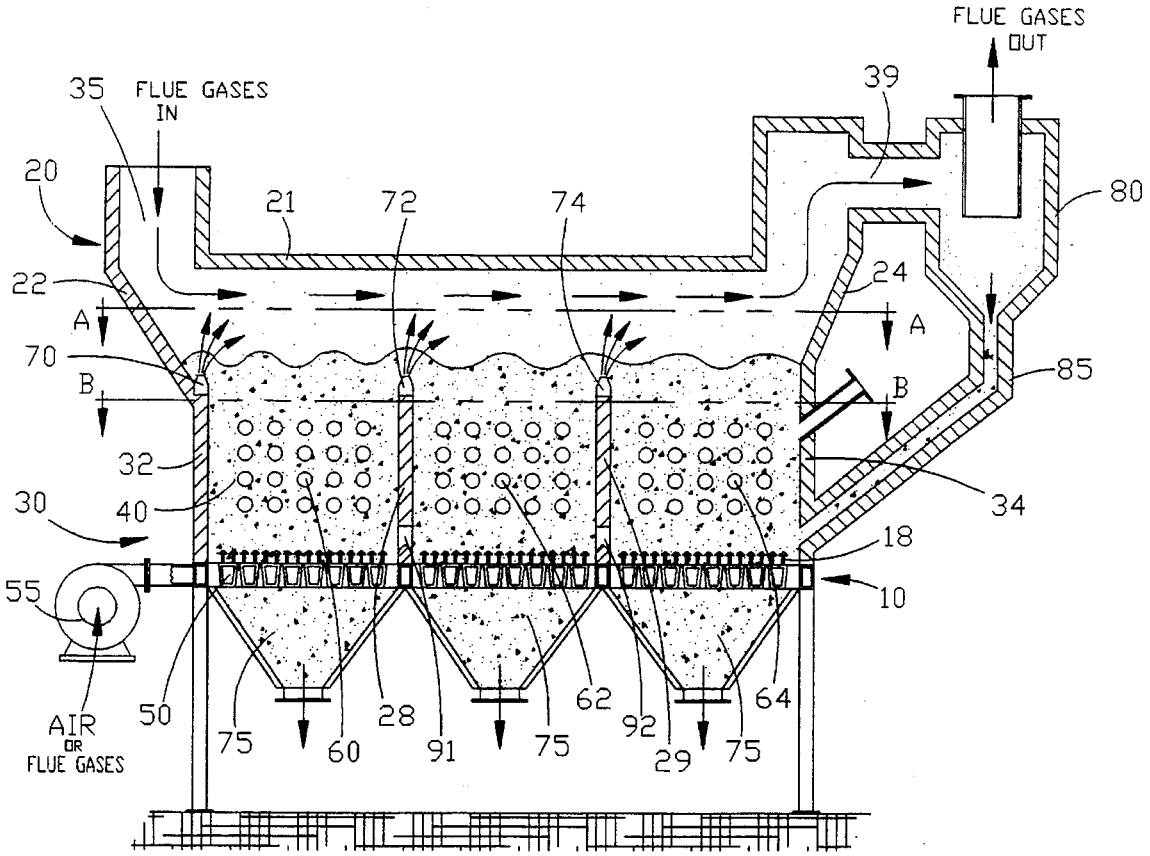
FIG. 1 is a section view of a preferred embodiment of the apparatus of the present invention.
Figure 2:
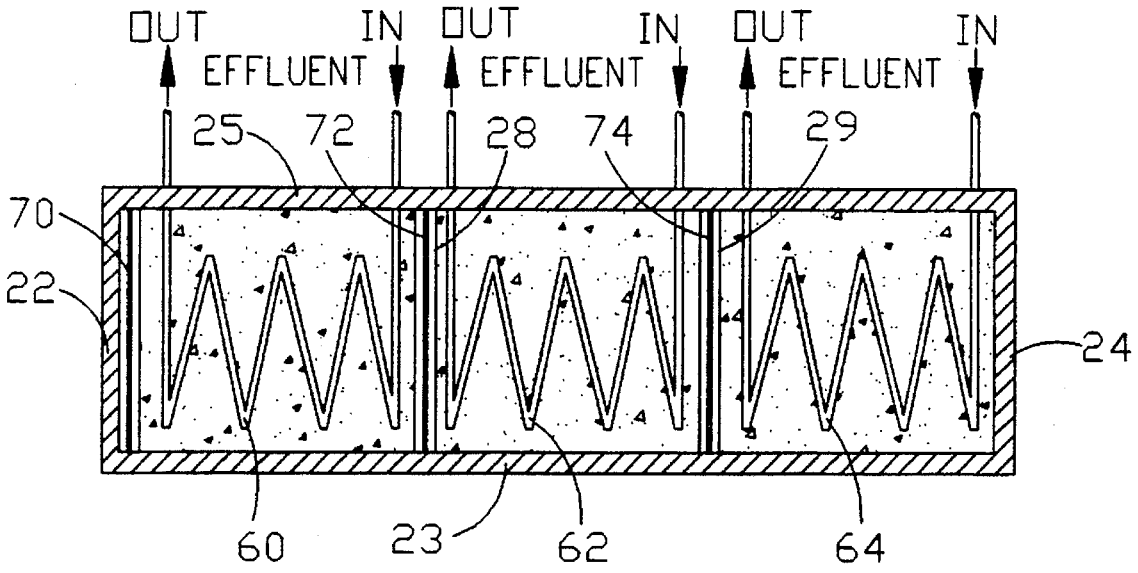
FIG. 2 is a section view of the preferred embodiment of the apparatus taken along line A—A of FIG. 1.

As embodied herein and as shown in FIGS. 1 and 2, a hot fluid passage 20 includes an upper wall 21, first end wall 22, second end wall 24, first side wall 23, and second side wall 25. In the preferred embodiment shown in FIG. 1, the hot fluid enters the hot fluid passage 20 through an opening 35 between the first end wall 22 and the upper wall 21 and exits through an opening 39 between the upper wall 21 and the second end wall 24. The hot fluid passage 20 can be any structure or shape that guides hot fluid through the heat exchanger and exposes it to a fluidized bed.

Figure 3:
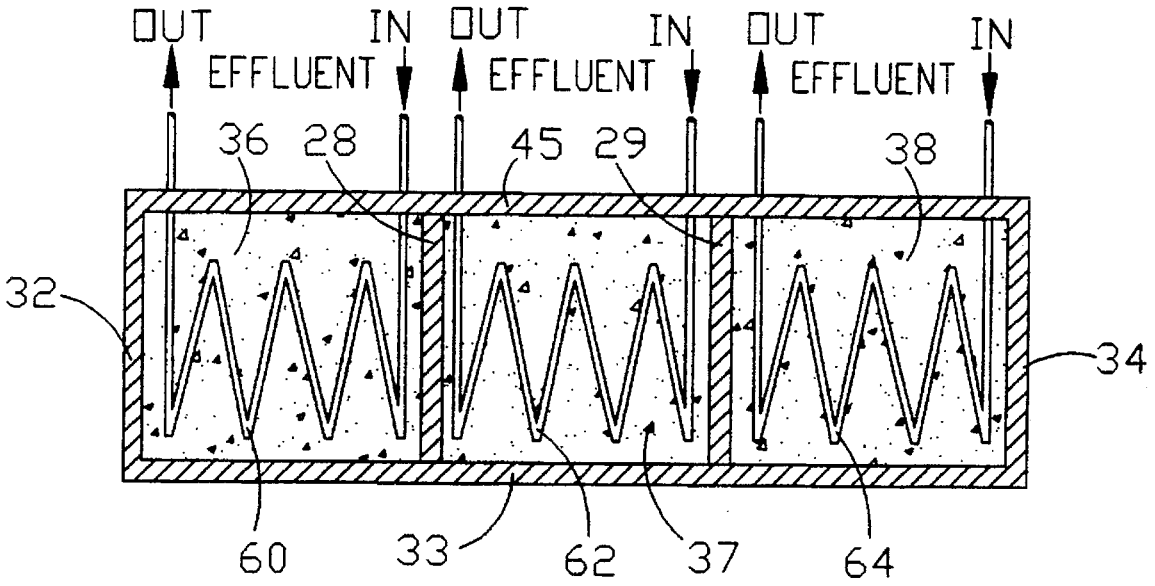
FIG. 3 is a section view of the preferred embodiment of the apparatus taken along line B—B of FIG. 1.

As embodied herein and as shown in FIGS. 1 and 3, a compartment 30 for containing the fluidized bed 40 includes a fluidized bed air distributor 10 that supports the fluidized bed, first end wall 32, second end wall 34, first side wall 33, and second side wall 45. The first side wall 33 and second side wall 45 are preferably substantially rectangularly shaped with their longer sides extending substantially parallel to the direction of flow of the hot fluid.

The air distributor 10 of compartment 30 both supports bed 40 and allows relatively large particulates and contaminants to be discharged from the bed. In the preferred embodiment shown in FIG. 4, the air distributor 10 is a bar grate that allows material to pass through openings 16, while maintaining bed 40 in suspension with gas distributed through hollow bars 50 and air nozzles 18.

As shown in FIG. 1, the fluidized bed heat exchanger preferably includes a source of pressurized gas (air), such as a blower 55, that forces gas into hollow bars 50 of air distributor 10. The bars 50 guide the gas to the air nozzles 18, which in turn inject the gas into the bed 40 to "fluidize" it. The fluidization of bed 40 keeps most of the particulates above air distributor 10. The fluidizing agent preferably is ambient air or relatively cold, recycled flue gases.

Hot gases entering the fluidized bed heat exchanger through the opening 35 can contain contaminants in the solid, liquid or gaseous form. The liquid and gaseous contaminants contained in the hot fluid passing over the fluidized bed 40 may change their phases to a solid phase due to a temperature reduction occurring in the fluidized bed heat exchanger.

The compartment 30 preferably is separated into subcompartments by partitions, as shown in FIGS. 1, 2 and 3, to control the temperature in sections of the fluidized bed 40. Preferably, a first partition 28 and a second partition 29 divide the compartment 30 into a first subcompartment 36, a second subcompartment 37, and a third subcompartment 38. Providing the partitions allows the apparatus to essentially have a plurality of fluidized beds 40 that can have different temperatures.

In the preferred embodiment, the tops of the first partition 28 and the second partition 29 are located below the upper surface of the fluidized bed 40. The first partition 28 and the second partition 29 preferably have bottom openings 91 and 92, respectively, located near the bottom of the fluidized bed. Particulates in the fluidized bed 40 can move through the subcompartments by passing through the bottom openings 91 and 92 and over the tops of partitions 28 and 29, thereby evenly distributing particulates throughout the fluidized bed 40.

In the preferred embodiment, a heat transfer device 60 is provided in every subcompartment. More specifically, the first heat transfer device 60 is in contact with the fluidized bed of the first subcompartment, a second heat transfer device 62 is in contact with the fluidized bed of the second subcompartment, and a third heat transfer device 64 is in contact with the fluidized bed of the third subcompartment. In the presently preferred embodiment, the heat transfer devices 60, 62, and 64 are tube coils known to those skilled in the art. The heat from the fluidized bed is transferred to the cooling fluid in the tube coil for use in an industrial process. The cooling fluid in the tube coil can be water, air, or any other gas or fluid. The temperature of the fluidized bed in each subcompartment can be individually controlled by controlling the amount of fluidized bed particulates directed into the stream in the passage 20.

The heat exchanger of the present invention preferably includes a first series of nozzles 70 in the compartment 30 below the upper surface of the fluidized bed 40, wherein air or flue gases blown through the first series of nozzles 70 force solid particulates from the fluidized bed 40 into the gas in the hot fluid passage 20. Preferably, as shown in FIG. 1, the first series of nozzles 70 is located substantially near the point where the fluid enters the hot fluid passage 20. Also, preferably, the first series of nozzles extends in spaced intervals along substantially the entire width of compartment 30, i.e., along substantially the entire length of first end wall 32.

Nozzles are preferably provided for each subcompartment. More specifically, first series of nozzles 70, second series of nozzles 72, and third series of nozzles 74 are provided for first subcompartment 36, second subcompartment 37, and third subcompartment 38, respectively. Each nozzle is preferably located upstream (relative to the hot gaseous stream) along the entire width of the corresponding subcompartment. As shown in FIG. 1, first series of nozzles 70, second series of nozzles 72, and third series of nozzles 74 are located on the top of first end wall 32, first partition 28, and second partition 29, respectively.

Figure 4:
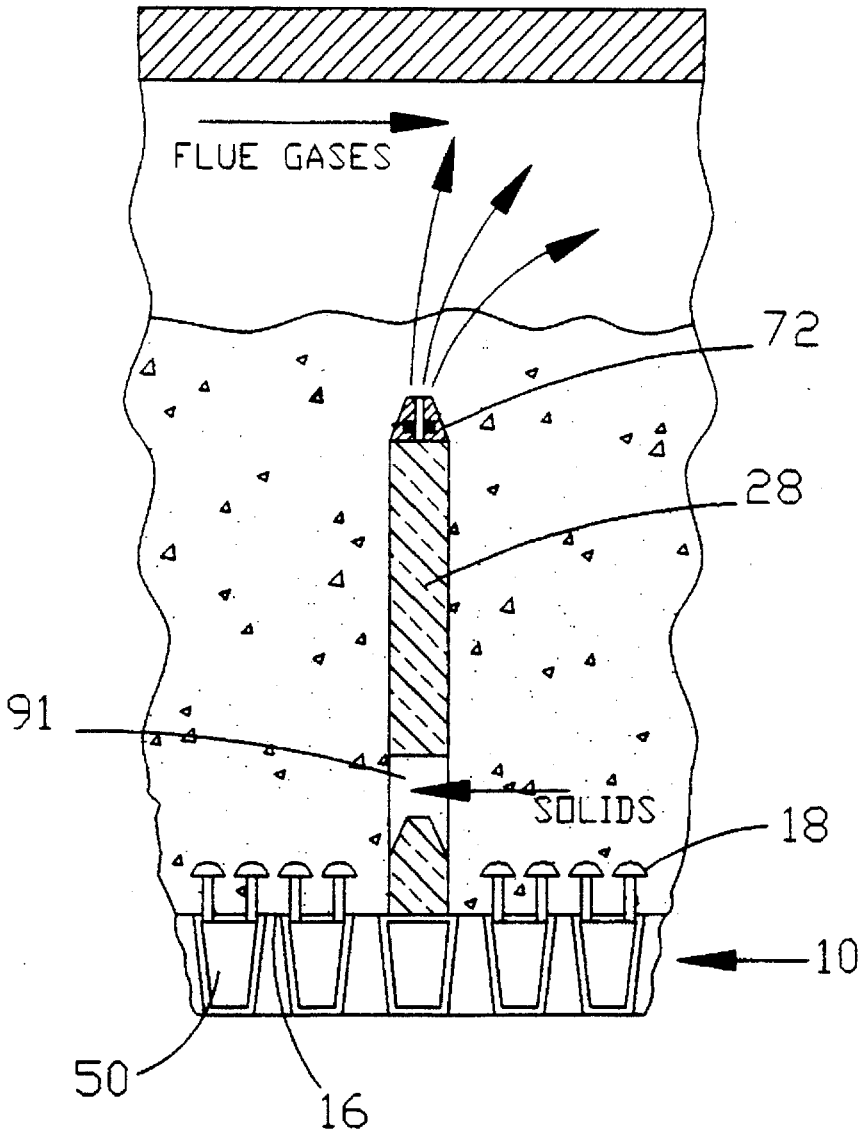
FIG. 4 is a side view of a nozzle and a partition of the apparatus shown in FIG. 1.
Figure 4A:
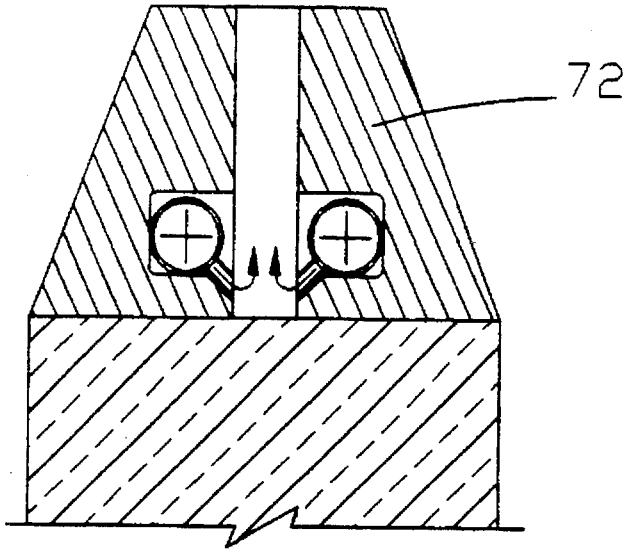

FIGS. 4 and 4*a* illustrate a nozzle of the second series of nozzles 72. As shown in FIGS. 1, 4, and 4*a*, the series of nozzles 70, 72, 74 are located proximate to an upper surface of the fluidized bed and oriented in a direction facing at least partially toward the upper surface.

Figure 5:
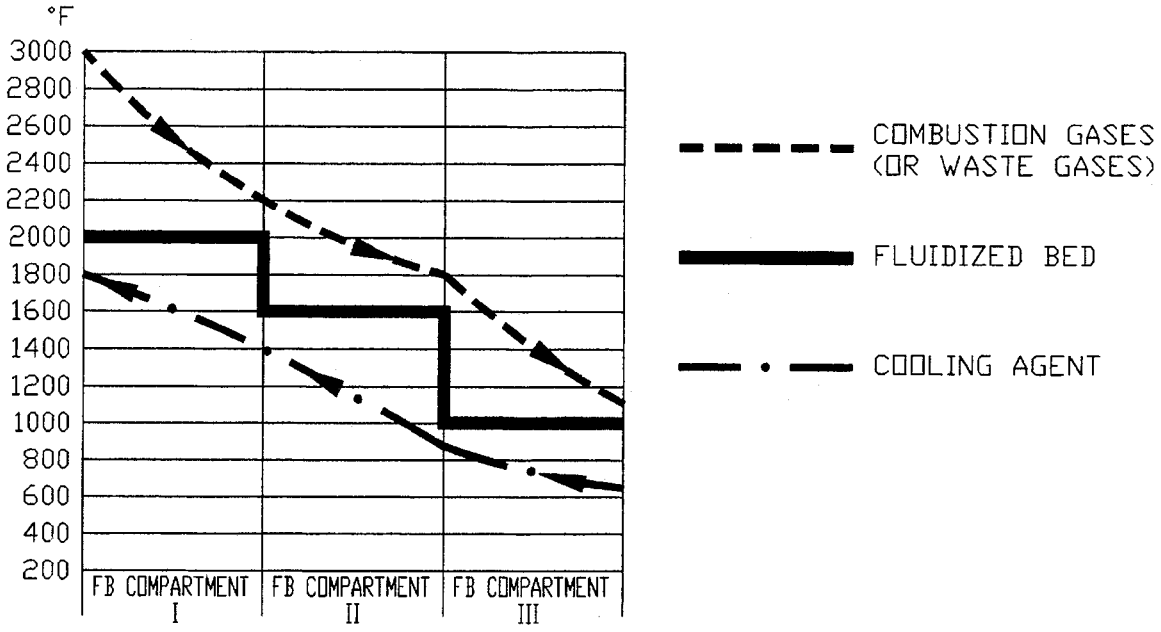
FIG. 5 is a graph depicting projected temperature distribution within the heat exchanger.

The nozzles can control the temperature of the fluidized bed by changing the amount of air and particulates forced into the gas stream. For example, as more particulates are forced into the gas stream, more heat is transferred to the bed. The amount of particulates forced into the fluid can be changed by, for example, varying the amount of gas blown through the nozzles. Air or flue gases can be provided to the series of nozzles 70, 72 and 74 by any known distribution system (not shown). Preferably, the gas distribution system can individually control the amount of gas supplied to each series of nozzles 70, 72, and 74 to individually control the rates at which the nozzles force particulates into the hot fluid, thereby individually controlling the fluidized bed temperature in each of the subcompartments. By way of example only, FIG. 5 presents a projected temperature distribution in the three subcompartments of compartment 30.

As embodied herein, the means for separating particulates from the fluid that has passed through the hot fluid passage 20 is a particulate reinjection system 80. This system 80 acts to capture the particulates from the fluidized bed that would otherwise escape with the exhaust gases to thereby maintain the fluidized bed inventory. Known particulate reinjection systems include a cyclonic separator and/or baghouse. The separating means, however, can be any device that effectively separates particulates from fluid in the environment in which the heat exchanger is being used. The separating means preferably separates from the cooled down gas stream the particulates carried over from bed 40 and contaminants originally contained in the hot gas stream. Thus, the separating means may recycle particulates from bed 40 and remove to a certain extent contaminants from the hot fluid.

As embodied herein, a return passage 85 for returning separated particulates to the fluidized bed in the compartment extends between the separating means 80 and the compartment 30. This simple solids recirculation system acts to increase the reliability of the heat exchanger. Preferably the return passage 85 is made from any material that is appropriate to the reduced temperature and environment of the flue gases leaving the third subcompartment 38.

During operation as the fluidized bed particles enter the passage 20, the molten particles in the hot gases are caught on the colder fluidized bed particles. Particulates and contaminants of sufficient weight settle down onto air distributor 10. As shown in FIG. 4, these "heavy" particulates and contaminants eventually leave the bed 40 through openings 16. Particulates from bed 40 become heavy because contaminants in the fluid attach themselves to the particulates when the fluidized bed particulates are forced into the hot gas stream in the passage 20. Upon returning to the bed 40, the particulates will settle, if sufficiently heavy, onto the air distributor 10. Otherwise, the particulates will be forced back into the gas stream in the passage, where they may pick up more contaminants. This cycle will continue until the particulates are sufficiently heavy to settle onto the air distributor 10 and eventually leave the bed 40 by passing through openings 16 to be discharged through hoppers 75. Contaminants that enter bed 40 may alone possess sufficient size to settle onto the air distributor 10 and leave the bed 40 through openings 16 or may gain weight by combining with other particulates or contaminants.

The tendency of the liquid contaminants to be solidified on the fluidized bed particulates under appropriate temperature conditions allows the heat exchanger to improve the quality of fluid expelled to the atmosphere. Most of the gaseous contaminants will be condensed in the last subcompartment 38 where the temperature will be maintained as low as possible to achieve an increased fluidized bed heat exchanger efficiency. Since many of the gas stream's contaminants (such as gaseous $SO_2$, Cl, HCl, etc.) can react with the fluidized bed particulates, if limestone is used for bed inventory, they can be captured within the fluidized bed heat exchanger to a great extent, rather than being sent into the atmosphere. Thus, the heat exchanger of the present invention is environmentally preferred over other known heat exchangers.

In operation, the apparatus of the present invention efficiently recovers heat from a hot gas prior to that gas being vented to the atmosphere. A hot gas enters the heat exchanger through the opening 35 between the first end wall 22 and the upper wall 21 and passes over the surface of the fluidized bed of the first subcompartment 36. Gas ejected from the first series of nozzles 70 forces solid particulates from the fluidized bed into the hot gas. The solid particulates, which have a lower temperature than the hot gases, absorb heat from the hot gases. While traveling over the first subcompartment 36, the hot gases cannot carry all of the solid particulates and drop a certain amount of them back into the fluidized bed 40. Lower temperature particulates in the bed 40 then absorb heat from the higher temperature particulates dropped from the fluid, thereby delivering heat into the fluidized bed where the heat transfer device is installed. Heat will be transferred to a coolant fluid with the coils of the heat transfer device and subsequently will be utilized in an industrial process, rather than being lost to the environment.

The above described process is repeated as the hot gases pass over the second and third subcompartments. After passing over the entire fluidized bed 40, the hot gases enter the separating means 80, where particulates and contaminants in the hot fluid are removed to a great extent and returned to the fluidized bed 40 through the return passage 85. The particulates are redistributed through the fluidized bed 40 by passing through the bottom openings 91 and 92 in the partitions by underflow. Particulates and contaminants of sufficient weight leave the bed 40 through the openings 16 of air distributor 10. To maintain constant bed inventory, particulates and contaminants are discharged from the hoppers 75 located under corresponding subcompartments 36, 37, and 38.

The size and number of subcompartments can be varied based on, for example: the total amount of heat required; the desired temperature distribution between the subcompartments; the temperature differential between the bed 40 and the cooling fluid in the heat transfer device; the cooling fluid properties and pressures; the velocity of the hot fluid; the size of the particulates in the fluidized bed 40; the height of the fluidized bed 40; and the size of the heat transfer surface of the heat transfer device.

The fluidized bed 40 can be any material constituting relatively fine particulates that can be fluidized at relatively low velocities. In most applications, the fluidized bed material preferably is sand or limestone. The smaller the fluidized bed particles, the higher the heat transfer coefficient. The size range of 200–400 microns for fluidized bed materials is typically preferred.

The fluidized bed 40 of the present invention has a high heat transfer coefficient, i.e., up to or greater than 90 Btu/($ft^2$×h×°F.) at a superficial fluidizing velocity of about 0.6 ft/s for a particle size of about 200 microns. Only a small amount of gas (relative to the amount of hot fluid in the hot fluid passage 20) is required to fluidize the bed 40 at this velocity. Only a small amount of gas is used to fluidize the bed because that "cold"fluidizing gas cools the hot fluid in the hot gas passage, thereby reducing the efficiency of the heat exchanger.

The present invention reduces fouling or corrosion of the heat transfer devices 60, 62 and 64 because they directly contact only the bed 40, and have no contact with the hot fluid, which in many instances may contain contaminants. The separation or isolation of the heat transfer device from the hot fluid passage 20 is an important aspect of the present invention. The heat transfer devices preferably are in heat exchange relationship with an external fluid or device that requires the heat. For example, the heat transfer device can be in heat exchange relationship with gases being injected into an industrial process, a fluid heating a boiler, or fluid for drying raw materials, among other things.

Thus, the present invention provides a new and useful heat exchanger that can provide greater than about 75% efficiency, depending upon the inlet temperature of the hot gases and the process in which it is used. The heat exchanger has low capital costs because it is compact and has few components. In sum, the present invention provides an efficient, reliable, and low-cost heat exchanger that can be used in a variety of processes and that improves the quality of waste gases expelled into the atmosphere.

It will be apparent to those skilled in the art that various modifications and variations can be made in the heat exchanger of the present invention and in its construction without departing from the scope or spirit of the invention. Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A heat exchanger comprising:

a hot fluid passage for guiding hot fluid through the heat exchanger;

a compartment for containing a fluidized bed, the compartment exposing an upper surface of the fluidized bed to the fluid in the hot fluid passage;

a first series of nozzles located substantially in the compartment proximate to and below the upper surface of the fluidized bed, each of the first series of nozzles being oriented in a direction facing at least partially toward the hot fluid passage such that gas blown through each of the first series of nozzles forces particulates from the fluidized bed into the fluid in the hot fluid passage;.

a first heat transfer device in contact with the fluidized bed;

means for separating particulates from the fluid that has passed through the hot fluid passage; and a return passage for returning separated particulates to the fluidized bed in the compartment.

2. The heat exchanger of claim 1, further comprising fluidizing nozzles for guiding gas into the bed in the compartment to fluidize the bed.

3. The heat exchanger of claim 1, further comprising a first partition in the compartment for substantially separating the fluidized bed in the compartment into at least a first subcompartment and a second subcompartment.

4. The heat exchanger of claim 3, wherein the first partition has an opening through which particulates in the fluidized bed can pass.

5. The heat exchanger of claim 3, wherein the first series of nozzles is located substantially in the first subcompartment.

6. The heat exchanger of claim 5, further comprising a second series of nozzles located substantially in the second subcompartment proximate to and below the upper surface of the fluidized bed, each of the second series of nozzles being oriented in a direction facing at least partially toward the hot fluid passage such that gas blown through each of the second series of nozzles forces solid particulates from the fluidized bed into the fluid in the hot fluid passage.

7. The heat exchanger of claim 6, further comprising:

a second partition in the compartment for substantially separating the fluidized bed in the compartment into at least the second subcompartment, and a third subcompartment; and a third series of nozzles located substantially in the third subcompartment proximate to and below the upper surface of the fluidized bed, each of the third series of nozzles being oriented in a direction facing at least partially toward the hot fluid passage such that gas blown through each of the third series of nozzles forces solid particulates from the fluidized bed into the fluid in the hot fluid passage.

8. The heat exchanger of claim 3, wherein a top of the first partition is located below the upper surface of the fluidized bed.

9. A heat exchanger comprising:

a hot fluid passage for guiding hot fluid through the heat exchanger;

a compartment for containing a fluidized bed, the compartment exposing an upper surface of the fluidized bed to the fluid in the hot fluid passage;

a first heat transfer device in contact with the fluidized bed;

a first partition in the compartment for substantially separating the fluidized bed in the compartment into at least a first subcompartment and a second subcompartment, a top of the first partition being located below the upper surface of the fluidized bed;

a series of nozzles located substantially at the top of the first partition, wherein gas blown through the series of nozzles forces solid particulates from the fluidized bed into the fluid in the hot fluid passage;

means for separating particulates from the fluid that has passed through the hot fluid passage; and a return passage for returning separated particulates to the fluidized bed in the compartment.

10. The heat exchanger of claim 3, wherein the first heat transfer device is in contact with the fluidized bed in the first subcompartment.

11. The heat exchanger of claim 10, further comprising a second heat transfer device in contact with the fluidized bed in the second subcompartment.

12. The heat exchanger of claim 11, further comprising:

a second partition in the compartment for substantially separating the fluidized bed in the compartment into at least the second subcompartment, and a third subcompartment; and a third heat transfer device in contact with the fluidized bed in the third subcompartment.

13. The heat exchanger of claim 3, further comprising a second partition in the compartment for substantially separating the fluidized bed in the compartment into at least the second subcompartment, and a third subcompartment.

14. The heat exchanger of claim 13, wherein the second partition has an opening through which particulates in the fluidized bed can pass.

15. The heat exchanger of claim 13, wherein a top of the second partition is located below the upper surface of the fluidized bed.

16. A heat exchanger comprising:

a hot fluid passage for guiding hot fluid through the heat exchanger;

a compartment for containing a fluidized bed, the compartment exposing an upper surface of the fluidized bed to the fluid in the hot fluid passage;

a first heat transfer device in contact with the fluidized bed;

a first partition in the compartment for substantially separating the fluidized bed in the compartment into at least a first subcompartment, and a second subcompartment;

a second partition in the compartment for substantially separating the fluidized bed in the compartment into at least the second subcompartment, and a third subcompartment, a top of the second partition being located below the upper surface of the fluidized bed;

a series of nozzles located substantially at the top of the second partition, wherein gas blown through the series of nozzles forces solid particulates from the fluidized bed into the fluid in the hot fluid passage;

means for separating particulates from the fluid that has passed through the hot fluid passage; and a return passage for returning separated particulates to the fluidized bed in the compartment.

17. A method for exchanging heat, comprising the steps of:

guiding fluid over an upper surface of a fluidized bed in a heat exchanger;

forcing solid particulates from the fluidized bed into the fluid by blowing gas toward the fluid from a series of nozzles located proximate to and below the upper surface;

removing heat from the fluidized bed;

separating particulates from the fluid; and returning separated particulates to the fluidized bed.

18. The method of claim 17, further comprising the step of controlling temperature of the fluidized bed by controlling particulate amount forced from the fluidized bed into the fluid.

19. The method of claim 17, further comprising the step of controlling temperature of the fluidized bed by controlling heat amount removed from the fluidized bed.

20. The method of claim 17, further comprising the step of substantially separating the fluidized bed into first and second subcompartments.

21. The method of claim 20, further comprising the step of controlling temperature of the fluidized bed in each subcompartment by controlling particulate amount forced from the fluidized bed in each subcompartment into the fluid.

22. The method of claim 20, further comprising the step of controlling temperature of the fluidized bed in each subcompartment by controlling heat amount removed from the fluidized bed in each subcompartment.

23. The method of claim 22, further comprising the step of controlling temperature of the fluidized bed in each subcompartment by controlling particulate amount forced from the fluidized bed in each subcompartment into the fluid.

24. The method of claim 20, further comprising the step of controlling temperature of the fluidized bed in each subcompartment by controlling heat amount removed from the fluidized bed in each subcompartment.

25. The method of claim 17, further comprising the step of substantially separating the fluidized bed into first, second, and third subcompartments.

26. The method of claim 17, wherein the step of removing heat from the fluidized bed includes placing a heat transfer device in heat exchange relationship with the fluidized bed.

* * * * *